United States Patent [19]

Groover et al.

[11] Patent Number: 4,717,043

[45] Date of Patent: Jan. 5, 1988

[54] VENDOR COUPON DISPENSER

[75] Inventors: Phillip B. Groover, Marietta; Jose Batlle, Dunwoody, both of Ga.; Saburo Tatsuke, Gyoda; Masaaki Kozukue; Yukio Endo, both of Fukiage, Japan

[73] Assignee: The Coca-Cola Company, Atlanta, Ga.

[21] Appl. No.: 910,835

[22] Filed: Sep. 23, 1986

Related U.S. Application Data

[63] Continuation of Ser. No. 623,012, Jun. 21, 1984, abandoned.

[51] Int. Cl.[4] ..... B65H 1/06; B65H 7/14

[52] U.S. Cl. ..... 221/7; 221/13; 221/231; 271/110

[58] Field of Search ..... 221/13, 93, 231, 251, 221/259, 260, 7; 271/110, 111

[56] References Cited

U.S. PATENT DOCUMENTS

| | | | |
|---|---|---|---|
| 1,061,585 | 5/1913 | Armstrong . | |
| 1,919,238 | 7/1933 | McCarthy . | |
| 2,764,409 | 9/1956 | Bombard . | |
| 3,220,605 | 11/1965 | Casey | 221/259 X |
| 3,506,258 | 4/1970 | Linquist . | |
| 3,575,410 | 4/1971 | Suzuki | 271/111 |
| 4,121,536 | 10/1978 | Chamberlain et al. | 221/13 X |
| 4,443,006 | 4/1984 | Hasegawa | 271/10 |
| 4,463,874 | 8/1984 | Friedman et al. | 221/238 |

FOREIGN PATENT DOCUMENTS

| | | |
|---|---|---|
| 0087487 | 7/1983 | European Pat. Off. . |
| 82/00025 | 1/1982 | PCT Int'l Appl. . |
| 1463906 | 2/1977 | United Kingdom . |
| 2126991 | 4/1984 | United Kingdom . |

OTHER PUBLICATIONS

Church et al, "Dynamic Sheet Length Sensing", IBM Tech. Disclosure Bulletin, vol. 18, No. 2, 7/75—pp. 330–331.

*Primary Examiner*—F. J. Bartuska

*Attorney, Agent, or Firm*—Birch, Stewart, Kolasch & Birch

[57] ABSTRACT

A sheet or coupon dispensing apparatus includes a magazine for storing a plurality of sheets or coupons and components for advancing each sheet individually from the magazine to a dispensed position. The apparatus is inoperative for dispensing another sheet until a previously dispensed sheet has been removed from the apparatus. The disclosed apparatus is especially adapted for use with automatic equipment, such as automatic vending machines.

13 Claims, 13 Drawing Figures

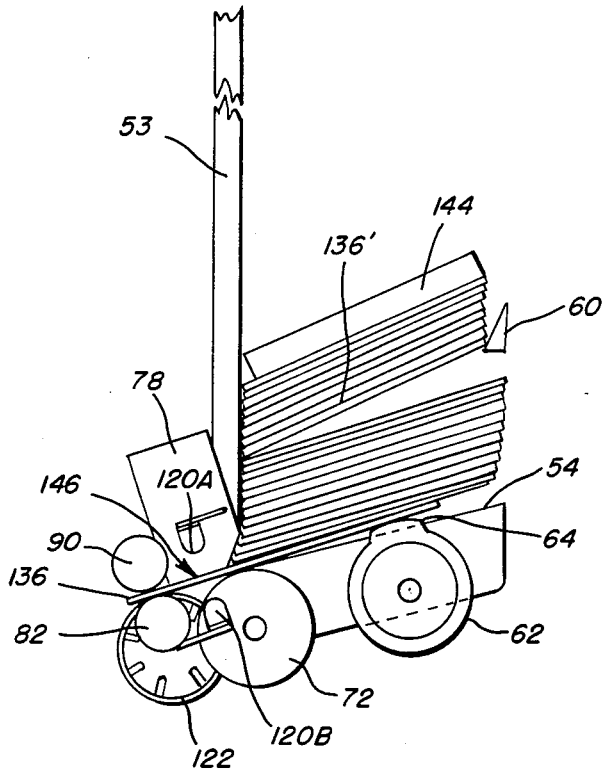
FIG. 10
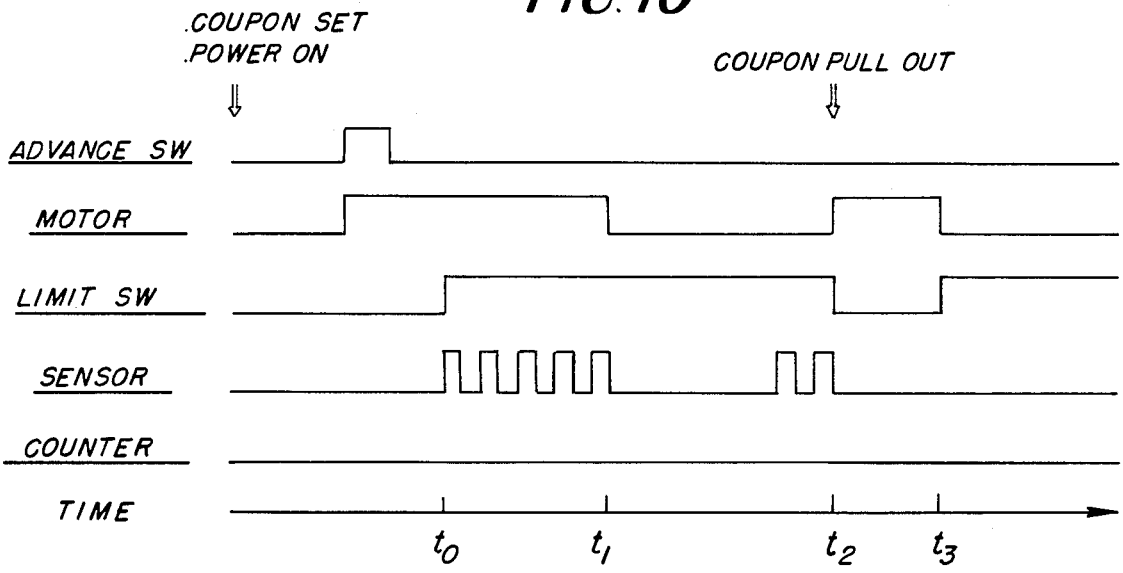
FIG. 11 TIME CHART "INITIAL SET"

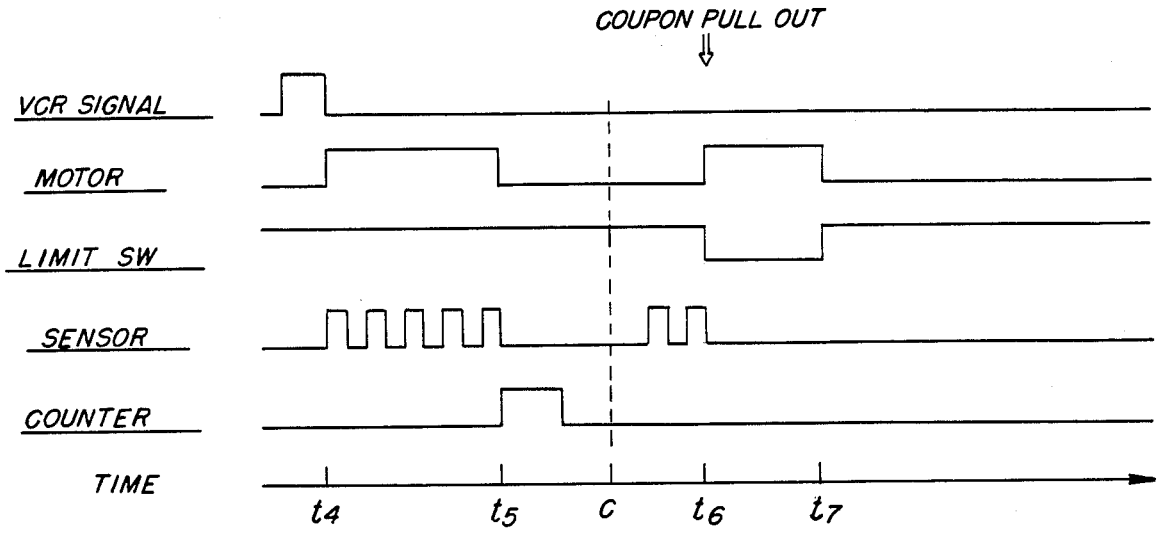
FIG. 12 TIME CHART "OPERATING"
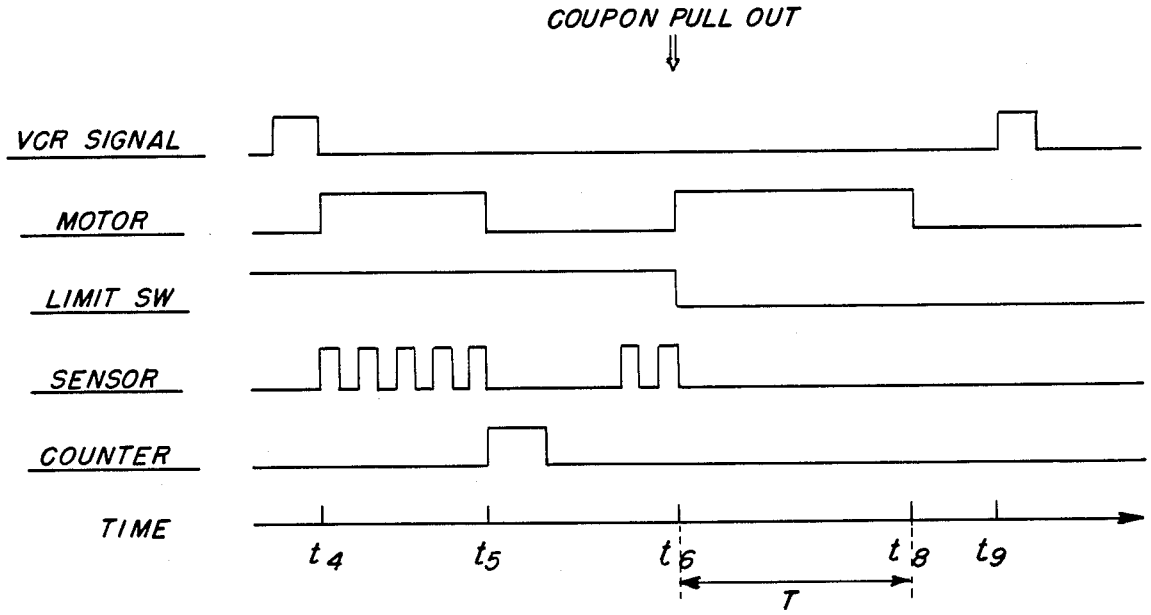
FIG. 13 TIME CHART "AT EMPTY"

VENDOR COUPON DISPENSER

This application is a continuation of application Ser. No. 623,012 filed on June 21, 1984 now abandoned.

FIELD OF THE INVENTION

The present invention relates to devices for dispensing sheets such as cards, coupons and the like, and further relates to improved dispensers of such type which are especially adapted for use in conjunction with an automatic vending machine.

BACKGROUND OF THE INVENTION

A variety of situations arise in which it may be desirable to automatically dispense cards, coupons and the like. For example, it may be desirable to automatically dispense coupons in conjunction with sales of merchandise, such as beverages, from automatic vending machines.

Automatic vending machines for vending beverages packaged in cans, bottles or similar containers are desirably adapted to perform, in addition to the actual dispensing of beverages, certain additional point-of-purchase functions. For example, such vending machines often comprise panels including areas for displaying promotional materials. It may also be desirable to adapt a vending machine to dispense promotional coupons and the like as an adjunct to a promotional scheme comprising displays associated with the machine. For this purpose, a reliable sheet or coupon dispensing apparatus suitable for use in an automatic vending environment is necessary.

Sheet or coupon dispensing means suitable for use in an automatic vending environment must, of course, function reliably in dispensing coupons in appropriate quantity at required times. However, merely ejecting a promotional coupon or the like upon generation of a suitable signal may not be enough to realize full benefit of any promotional scheme incorporating such coupons. It is also desirable to assure that the coupons are used in the most efficient manner possible, reaching the sector of the population most interested in obtaining such coupons. This is especially desirable when dispensing is performed by an unattended automatic device which is serviced and refilled only periodically. Should a stock of promotional coupons be exhausted prematurely between service intervals, a significant time may pass during which the pomotional scheme including the dispensing of coupons is not effectively carried out.

Accordingly, it is an object of the present invention to provide an improved dispenser for sheets, cards, coupons and the like.

A particular object of the invention is to provide an improved sheet dispenser which is suitable for use in conjunction with automatic vending machines.

A further object of the invention is to provide a sheet or coupon dispenser which makes the most efficient use possible of a stock of coupons within the dispenser.

An additional object of the invention is to provide a sheet or coupon dispenser having a mechanism which prevents dispensing of additional coupons until previously dispensed coupons have been removed from the dispenser.

Yet another object of the invention is to provide a vending machine combined with a coupon dispenser which is responsive to a signal from the vending machine for dispensing one coupon at a time.

A further object of the invention is to provide a coupon dispenser associated with a vending machine which dispenses coupons upon sale of merchandise from such machine, but does not dispense a coupon if a previously dispensed coupon has not been removed by a prior purchaser.

Yet another object of the invention is to provide an improved coupon dispensing apparatus which is suitable for use as a utility module in a vending machine, and which may be associated with a display panel of a vending machine.

SUMMARY OF THE INVENTION

The present invention relates to a sheet dispensing apparatus which comprises means for storing a plurality of sheets, means for advancing each sheet individually from the storage means to a dispensed position whereat a dispensed sheet is exposed at least partially from the apparatus, and means for preventing advancing of another sheet to the dispensed position until a previously dispensed sheet has been removed from the apparatus. Such sheet dispensing apparatus is desirably associated with a vending machine, such machine comprising means for providing an actuating signal to the dispensing apparatus upon each purchase from the vending machine.

In one aspect of the invention, the dispensing apparatus comprises storage means for storing a plurality of sheets, outlet means for passing the sheets from the apparatus, dispensing means including a first roller adjacent the storage means for advancing a sheet therefrom toward the outlet means, means for holding a dispensed sheet in a position whereat it is at least partially exposed outwardly of the outlet, and means for determining when a sheet in the dispensed position has been removed from the apparatus, the dispensing means being responsive to such determining means for enabling dispensing of another sheet. The dispensing means may additionally include a second roll for assisting in the dispensing operation and a separating member cooperating with the second roll for separating a sheet to be dispensed from adjacent sheets. The means for holding a sheet in the dispensed position may comprise a pair of opposed rollers. Suitable sensors appropriately positioned control operation of the dispensing means.

An additional aspect of the invention is that the dispensing means may advance a sheet from the storage means to an intermediate position prior to dispensing the sheet. An appropriate sensor may be provided for determining when a sheet has been advanced to the intermediate position. A dispenser in accordance with the invention may desirably include means for counting the number of of coupons actually dispensed by the apparatus.

BRIEF DESCRIPTION OF THE DRAWINGS

The above objects and features, as well as additional objects and features of the present invention will be best understood in view of the following description, taken together with the accompanying drawings in which:

FIG. 10 is a side sectional view of an apparatus like that of FIGS. 2–7 for illustrating the manner in which the apparatus dispenses a sheet or coupon;

FIG. 11 is a signal timing chart depicting a sequence of signals generated during operation of an apparatus in accordance with the invention during an initial setting operation;

FIG. 12 is a signal timing chart depicting a sequence of signals generated during operation of an apparatus in accordance with the invention in a normal operating mode; and FIG. 13 is a signal timing chart depicting a sequence of signals generated during operation of an apparatus in accordance with the invention when a stock of coupons therein becomes exhausted or a coupon becomes jammed.

DETAILED DESCRIPTION OF A PREFERRED EMBODIMENT

Figure 1:
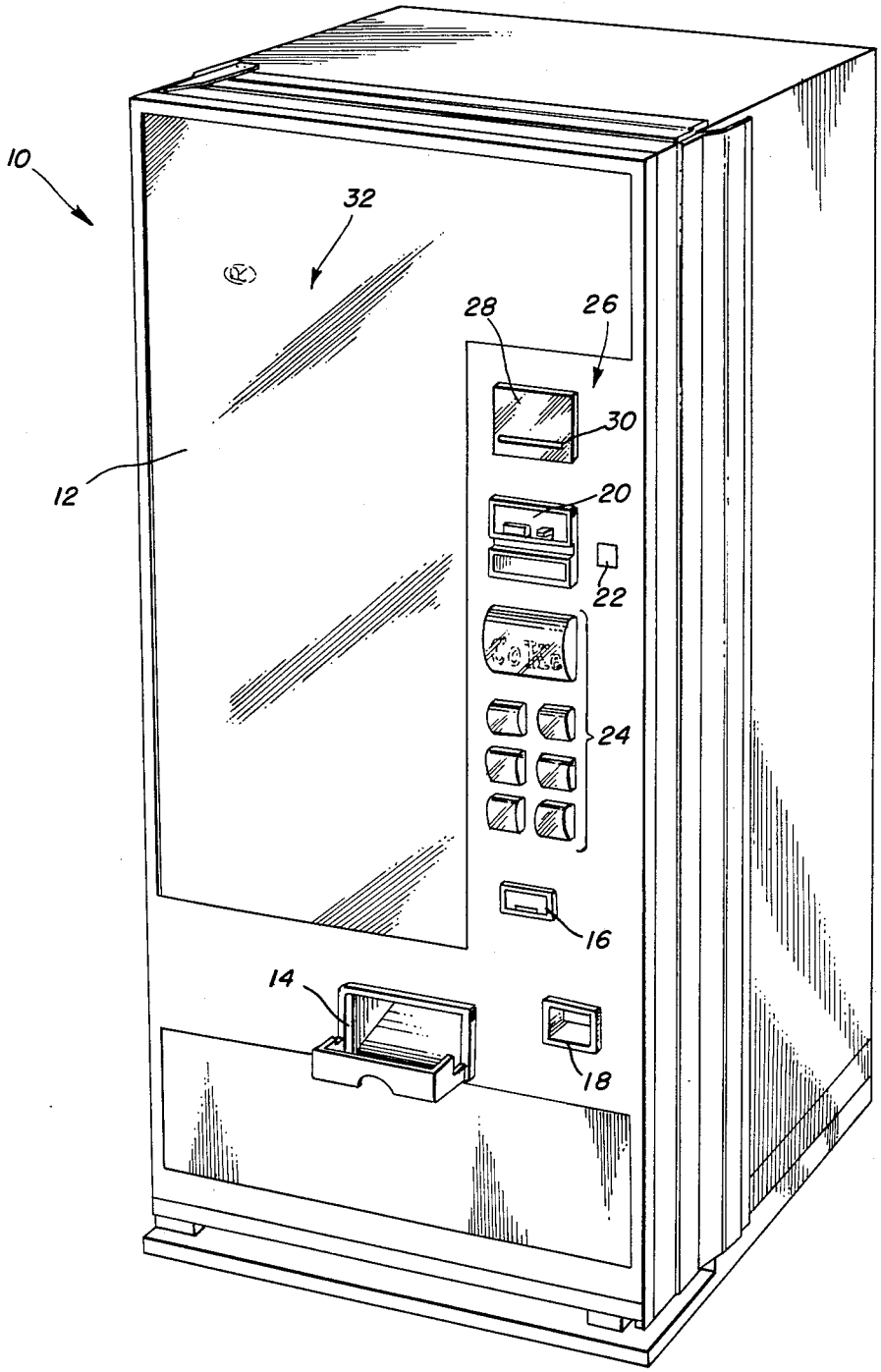
FIG. 1 is a perspective view of an automatic vending machine incorporating an improved coupon dispenser in accordance with the present invention.

FIG. 1 illustrates an automatic vendor, designated generally by reference numeral 10, of a type which might be used in conjunction with an automatic sheet or coupon dispenser in accordance with the principles of the present invention. Vending machines of this type are disclosed in U.S. Pat. No. 4,380,130 issued Apr. 19, 1983 and U.S. Pat. No. 4,454,670 issued on June 19, 1984, Ser. No. 327,461 filed Dec. 4, 1981) which are incorporated herein by reference. It should be noted, however, that while the present disclosure of this invention is with reference to automatic vending machines of the type illustrated in FIG. 1, it is not limited to machines of this type or configuration. The concepts and elements of the present invention are compatible with automatic vendors of other types, as well as with different types of equipment in addition to automatic vending machines.

It is additionally noted that, while the present invention is described as or in conjunction with a "sheet" or "coupon" dispenser, it is not intended to be limited by these terms. The present invention relates to dispensing of sheets, coupons, cards, labels and any other generally sheet-like materials of similar nature.

Referring again to FIG. 1, vendor 10 includes a front surface 12 which supports certain components of the machine. Among these are an outlet 14 for cans, bottles or the like sold by the machine, a coin return outlet 16, and a bottle opener 18, if appropriate. Other components or devices of vendor 10 with which a purchaser normally interfaces or interacts are a coin slot and coin return control 20, a sign or label 22 indicating the price of goods for purchases, and a group 24 of selector buttons by which a purchase selection is made. The buttons of group 24 may be clustered and/or arranged in a manner to promote the sale of one or more particular selections available from the machine, for example, by providing an enlarged prominent selector button for such particular product, as illustrated in FIG. 1.

An area 26 on front surface 12 is adapted to include an additional element or component associated with vendor 10. In accordance with the present invention, the additional component is a utility module in the form of a coupon dispenser. As shown in FIG. 1, area 26 includes a plate 28 having a slot 30 formed therein from which coupons or the like are dispensed in a manner to be described in greater detail hereinafter. Plate 28 may be adapted to bear advertisement, indicia or instructions to a purchaser. These may be in the form of materials pasted onto plate 28 if formed of metal or the like. Alternatively, plate 28 may be transparent plastic having means for receiving indicia-bearing inserts.

Area 26 of front surface 12 of vendor 10 is especially suitable for incorporation of a utility module such as a coupon dispenser in accordance with the present invention. This area is generally at eye level and therefore catches the attention of most purchasers. It is also adjacent the portions of surface 12 which carry the control devices by which a purchaser interacts with the vendor, such as coin slot 20, pricing label 22 and elector buttons 24, which draw the purchaser's attention toward the area 26. Area 26 is also near an additional display area 32 which carries advertisement or other promotional materials which likewise attract the attention of a purchaser. The plate 28 associated with the module therefore forms an integral element of a promotional display format embodied in the structure and appearance of vendor 10.

Additionally, locating plate 28 and its associated utility module in area 26 of front panel 12 facilitates mounting of the utility module per se on or adjacent the rear surface of front panel 12. In this location, the utility module is easily interfaced with control circuits of vendor 10 associated with coin-receiving means located behind coin slot 20, as well as with other operating components and circuits of the vendor associated with, for example, selector buttons 24. Therefore, a coupon dispensing module in accordance with the invention is easily retrofit into existing automatic vendors. Together with the other above-described components of such vendors, the coupon dispenser facilitates an effective promotional display, as well as an automatically operated apparatus for distributing promotional materials to consumers.

FIGS. 2–6 illustrate a sheet or coupon dispenser 40 in accordance with the invention. Dispenser 40 is housed in a cabinet having a front wall 42. Front wall 42 has a cover plate attached thereto which may be plate 28, described above. A rear door panel 44 covers the back portion of dispenser 40, while a top panel 45 extending from panel 44 covers the top of the dispenser when panel 44 is closed. Rear door panel 44 and top panel 45 are pivotal about hinges 46, affording access to the interior of the dispenser for loading. A pair of side panels 48 complete the exterior housing. A latch 50 is provided for maintaining rear door panel 44 in a closed position.

Dispenser 40 includes a magazine 52 for storing sheets or coupons in a generally vertical stack. Magazine 52 includes a front wall 53 and a pair of side walls 58. Hinged rear panel 44 forms a rear wall when in its closed position. A bottom member 54 is inclined downwardly toward the front portion of magazine 52 and includes openings 56 therein for permitting contact between sheets in the magazine and dispensing means to be described in greater detail hereinafter. A pair of absorbers 60 extend inwardly of magazine 52 and are supported by side walls 58. Absorbers 60 are wedge-shaped protrusions which support the weight of stacked coupons or sheets above the absorbers to avoid undue pressure on coupons adjacent the dispensing means of the apparatus, as will be described below.

Figure 3:
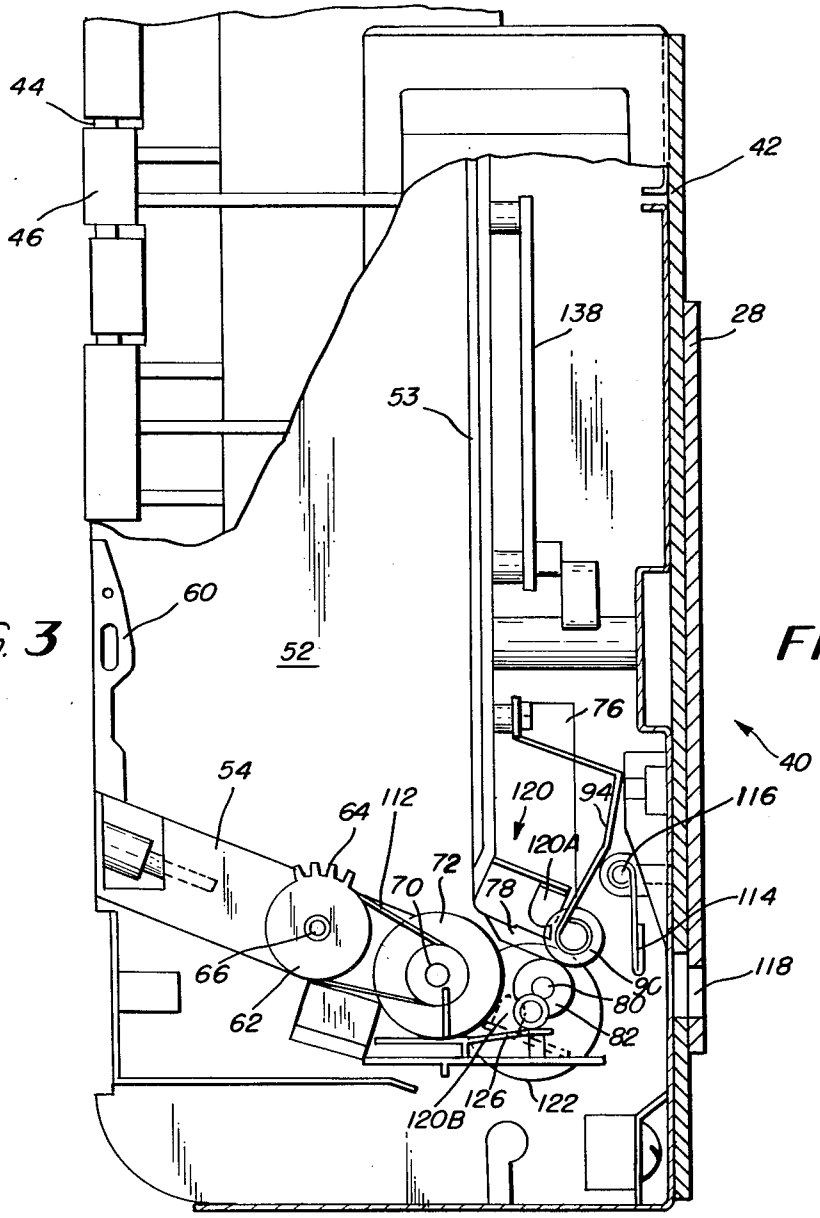
FIG. 3 is a sectional left-side elevational view along line 3—3 of FIG. 2.
Figure 5:
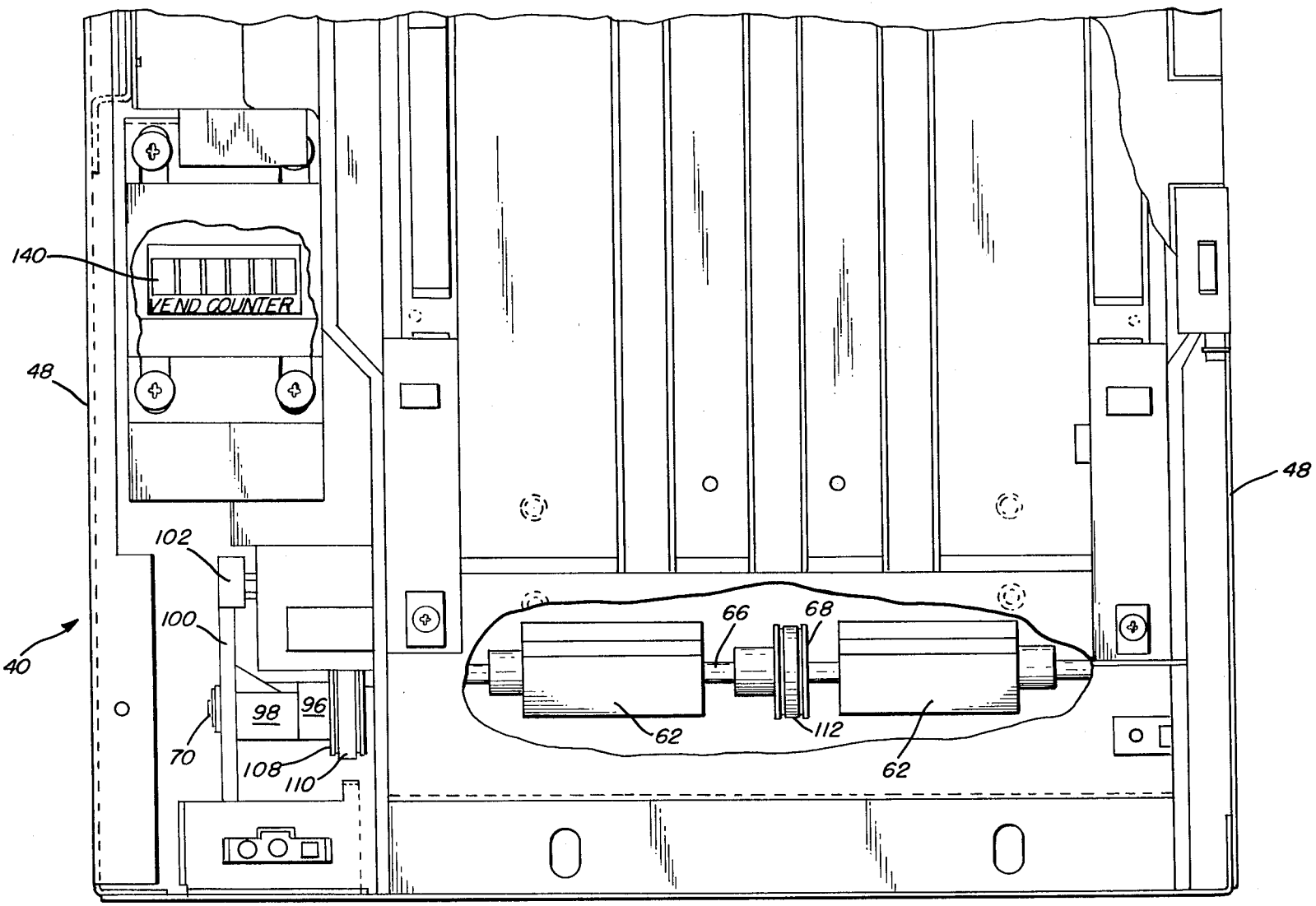
FIG. 5 is a rear elevational view, partly in section, of the dispenser of FIG. 2.

Positioned below bottom member 54 of magazine 52, in alignment with openings 56 is a first pair of eccentric rolls 62. These are designated "eccentric" rolls because, although they are generally cylindrical, they comprise protrusions 64 which give these rolls an overall eccentric appearance in cross-section, as shown in FIG. 3. Protrusions 64 may comprise, for example, a plurality of axially extending ribs of frictional material such as resilient rubber. Rolls 62 are mounted on a rotary shaft 66 which may be rotatably supported by bottom member 54 or side wall portions of magazine 52. Shaft 66 also carries a pulley 68 for the purpose of driving the shaft, as will be described in greater detail hereinafter.

Figure 6:
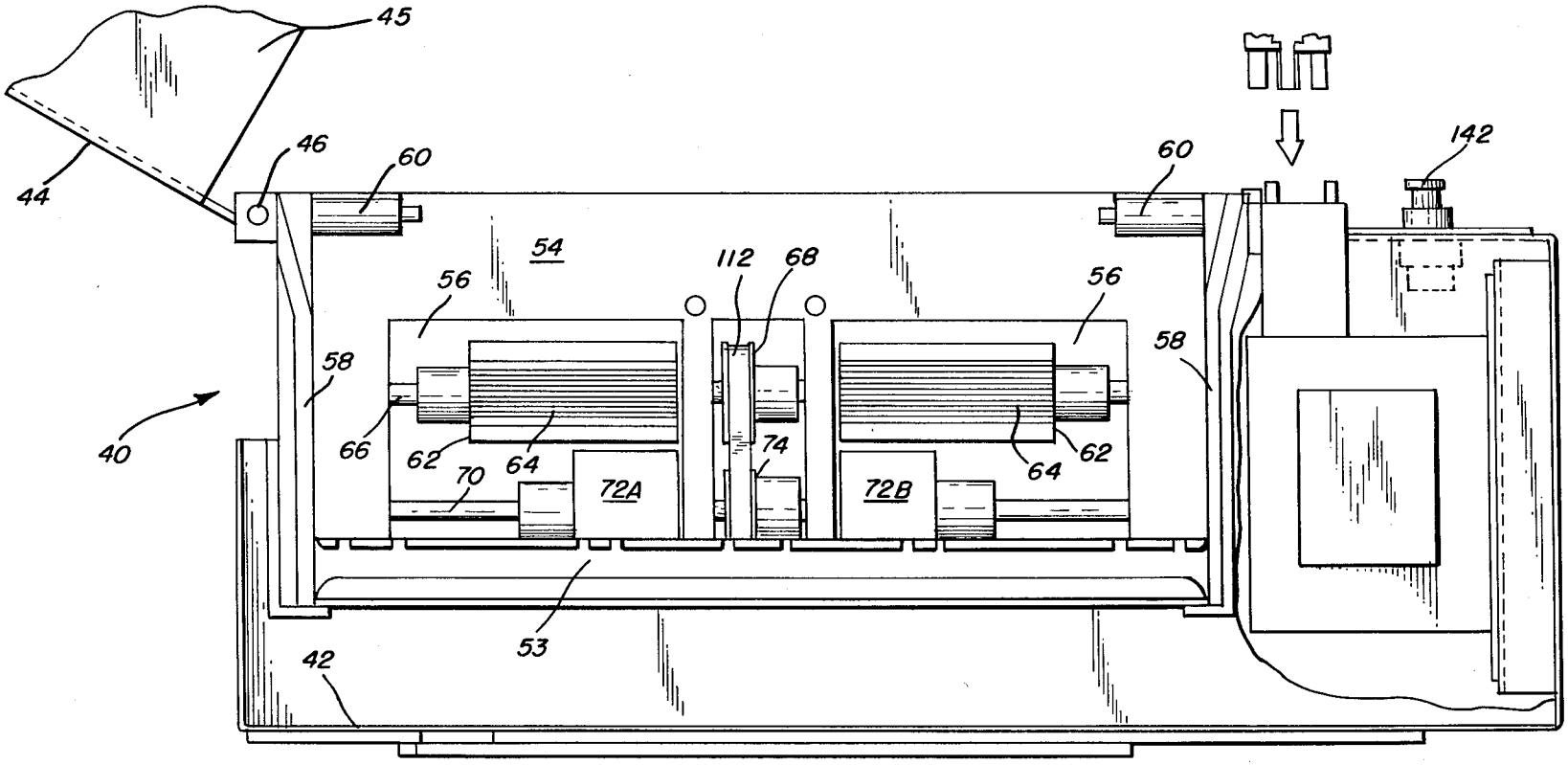
FIG. 6 is a top view of the dispenser of FIG. 2 with a closure member thereof in an opened position.
Figure 7:
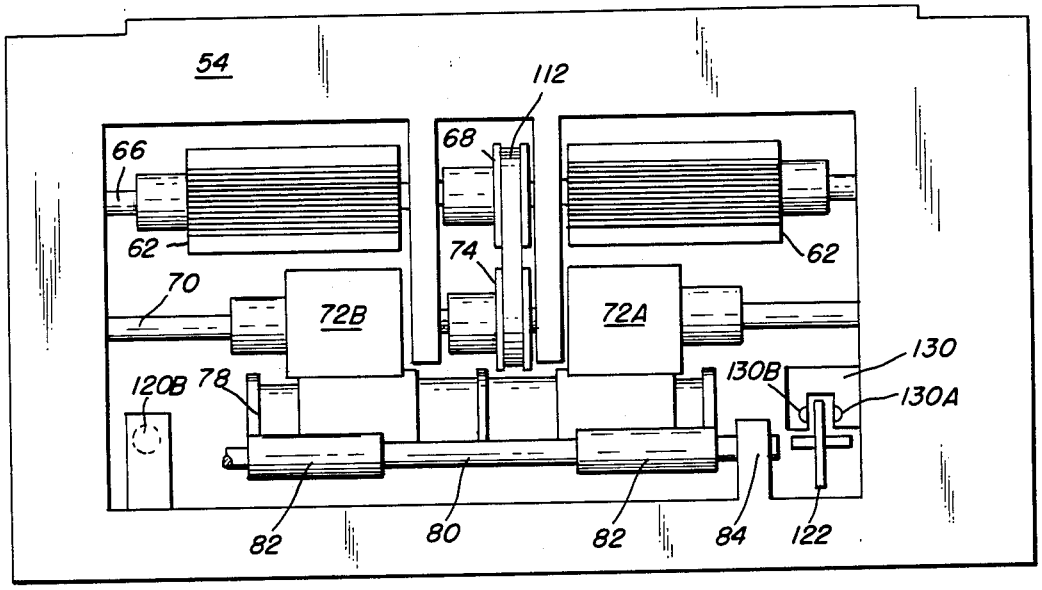
FIG. 7 is a bottom view of the dispenser of FIG. 2.

An additional rotary shaft 70 supports a feed roller 72. Roller 72 comprises portions 72A and 72B as best seen in FIGS. 6 and 7 of the drawings. Shaft 70 likewise carries a pulley 74.

Supported on front wall 53 of magazine 52 by a support means 76 is a separating member 78. Member 78 is, in the embodiment illustrated, an elongated block having alternate raised and recessed portions, as best seen in FIG. 7. Separating member 78 cooperates with delivery roll 72 to separate a single coupon from a stack of coupons in magazine 52 in a manner to be described below.

A third rotary shaft 80 supports a set of rolls 82 which will be designated, for the sake of discussion, as lower take-out rolls. Shaft 80 is supported at one end by a bearing block 84 or the like and at its other end by a wall portion 86 of the apparatus. A pulley 88 is associated with shaft 80 at a remote end thereof on an exterior side of wall portion 86. A pair of upper take-out rolls 90 is mounted on a shaft 92. Shaft 92 is supported on the surface of front wall 53 outside of magazine 52 by a resilient support member 94 which biases rolls 90 against rolls 82.

Rolls 72, 82 and 90, as well as separating member 78 comprise material, such as hard rubber or the like, which may engage sheets or coupons with a suitable frictional force. This enables roll 72 to engage a coupon in order to advance the coupon in a dispensing direction, enables separating member 78 to cooperate with roll 72 in a suitable manner by frictionally engaging certain coupons during the dispensing procedure, as will be described below, and facilitates a firm grasp of the coupon between rolls 82 and 90 during advancement of a coupon to a dispensed position, as will also be described below.

Rotary shaft 70 which supports delivery roll 72 extends through wall 86 and is supported by a bearing 96. At its end-most portion, shaft 70 carries a hub 98 and a driven gear 100. Gear 100 is engaged by a drive gear 102 associated with the output shaft of a motor 104. Motor 104 is supported by a bracket 106 on wall 86.

Figure 2:
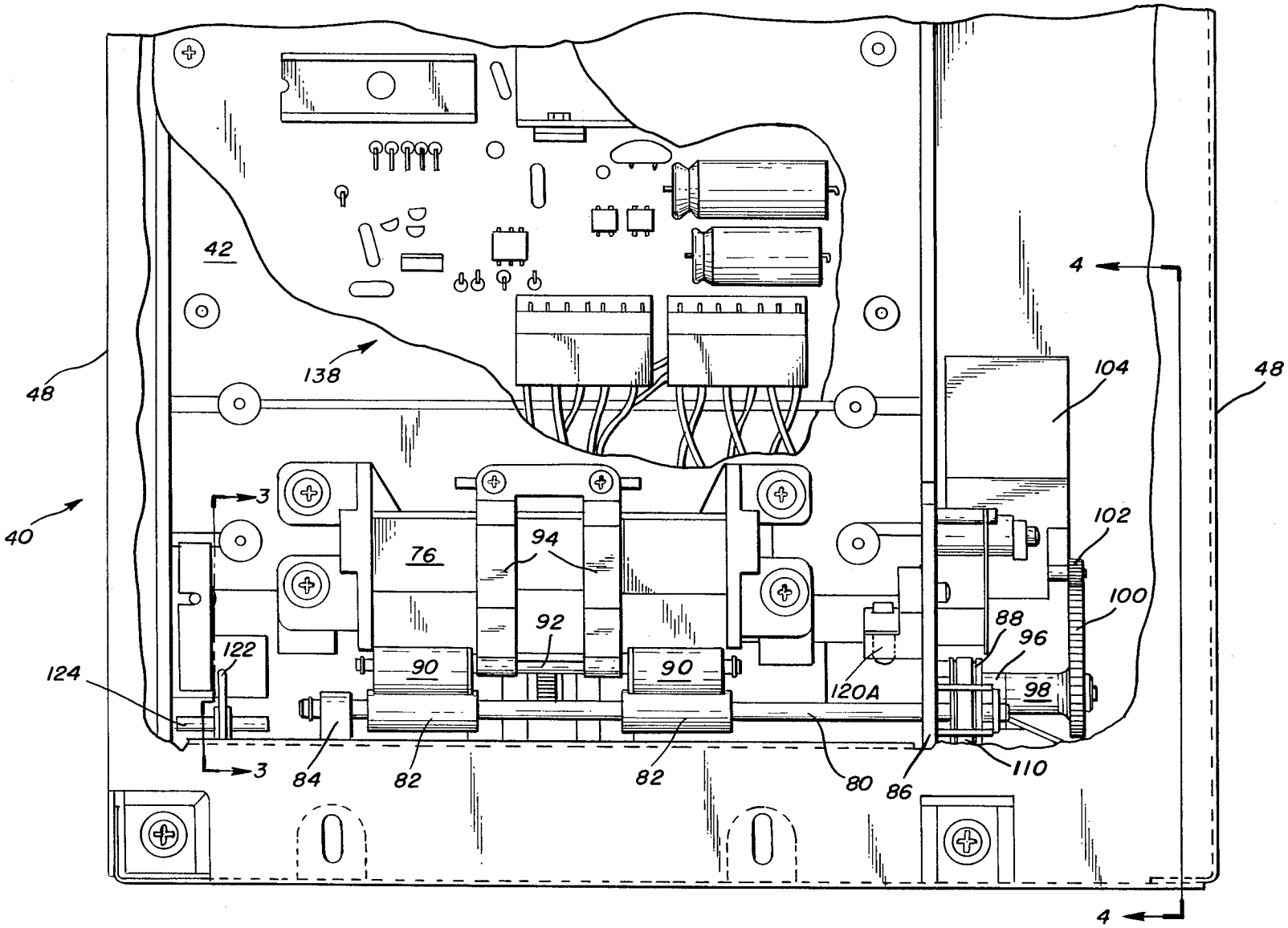
FIG. 2 is a front elevational view, partly in section, of a portion of an improved sheet or coupon dispenser in accordance with the invention.
Figure 4:
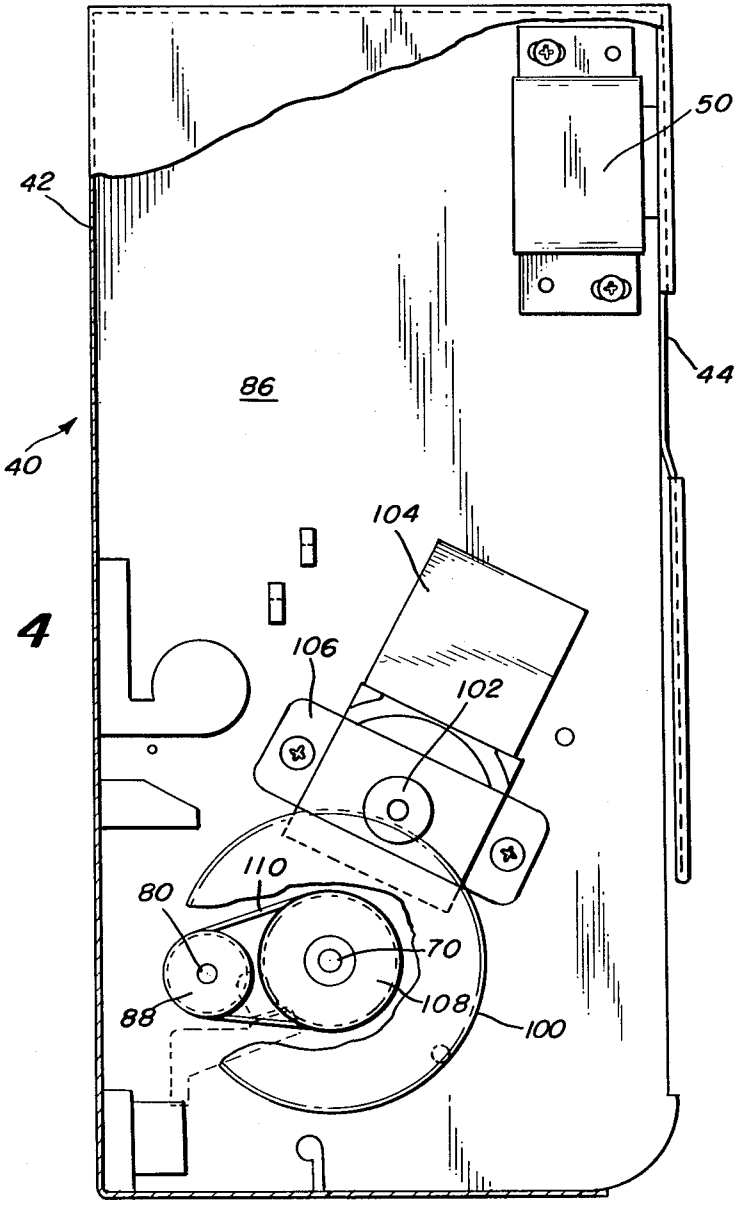
FIG. 4 is a sectional right-side elevational view along line 4—4 of FIG. 2.

When power is provided to motor 104, gear 100 is driven via gear 102, thus rotating shaft 70 and feed roller 72. An additional pulley 108 associated with shaft 70 drives shaft 80 via a belt 110 which extends between pulleys 108 and 88, as illustrated in FIGS. 2 and 4. Lower take-out rolls 82 rotate with shaft 80. Upper take-out rolls 90 which are frictionally engaged with rolls 82 are also driven in rotation. A second drive belt 112 extends between pulleys 74 and 68. As a result, shaft 66 and eccentric rolls 62 are rotatably driven along with shaft 70. The manner in which rotation of the above-described elements serves to dispense coupons will be described in greater detail hereinafter.

As illustrated in FIG. 3, dispenser 40 further includes a flap 114 pivoted about a support 116 and positioned generally between take-out rolls 82, 90. Flap 114 prevents insertion of objects as might damage the dispenser. Coupons are dispensed through an outlet or slot 118 which may correspond to slot 30 when the device is used in an automatic vendor in the manner described with reference to FIG. 1.

Dispensing apparatus 40 further includes a limit switch 120. In the embodiment shown in the drawing, limit switch 120 is an optical switch and includes an upper part 120A and a lower part 120B. One of parts 120A and 120B is a light-emitting part while the other is a light-receiving part. An imaginary line extending between parts 120A and 120B extends generally perpendicularly to a coupon dispensing path, the path extending generally between feed roll 72 and the nip point between take-out rolls 82 and 90. When a coupon to be dispensed, in a manner described below, reaches the imaginary line between limit switch parts 120A and 120B, it breaks a light beam extending between the two parts of limit switch 120, causing the switch to emit a signal. The purpose of this signal will become apparent in view of the description below.

Figure 8:
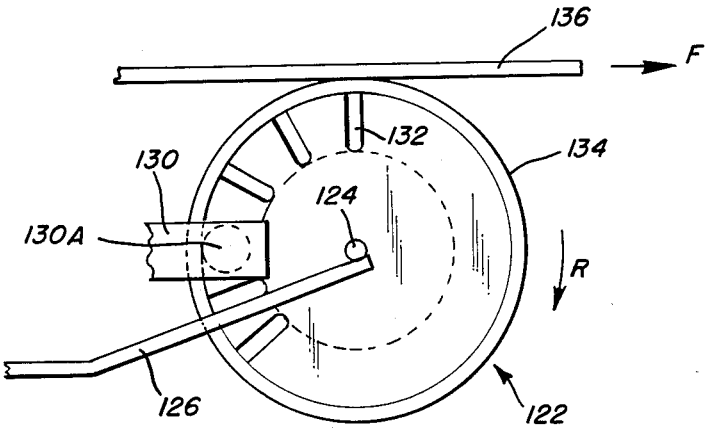
FIG. 8 is an enlarged detail view of a sensing device comprising part of the present invention.

An additional sensing means associated with the dispensing apparatus of the invention comprises a wheel 122 shown in FIGS. 2–3 and 7, and illustrated in detail in FIG. 8. Wheel 122 is rotatable about an axis 124. Axis 124, and thus wheel 122, is supported for movement in a direction generally perpendicular to the above-noted dispensing path and parallel to an imaginary line which passes through the axes of both shafts 80 and 92. Axis 124 may be supported in this manner by, for example, a pair of slots (not shown). Wheel 122 is supported in cantilevered fashion and biased upwardly by a resilient spring support 126. While wheel 122 is illustrated (FIG. 3) in a position wherein its circumference is above the nip point between take-out rolls 82 and 90, in use, the circumference of wheel 122 will be in alignment with the nip point and biased against a coupon passing between take-out rolls 82 and 90.

FIGS. 7–8 illustrate the additional sensing means in greater detail. Wheel 122 is surrounded in part by a detector 130 which, in the illustrated embodiment of the invention, includes a photocell detecting means. The photocell includes parts 130A and 130B. One of these parts is light-emitting while the other is light-receiving. Wheel 122 further comprises a plurality of radial slots 132 around its periphery. Light can pass through slots 132 when the slots are aligned with parts 130A and 130B. The circumference of wheel 122 comprises a rim 134 of high friction material, such as rubber, for engaging a sheet or coupon 136 as it passes in contact with wheel 122. Movement of coupon 136 in a dispensing direction F, as shown in FIG. 8, results in rotation of wheel 122 in rotary direction R, as also shown in FIG. 8. Rotation of wheel 122 results in emission of pulses by photocell device 130A, 130B, such pulses being employed to control the dispensing operation, as will be described in greater detail hereinafter.

A dispensing apparatus in accordance with the invention also includes a circuit board 138 (FIG. 2) which includes various control components, such as a microprocessor, for controlling operation of the dispenser. Circuit board 138 is mounted on wall 53 of the apparatus. A counter 140 (FIG. 5), positioned on the apparatus at a location whereat it is readily visible, is responsive to a signal generated during dispensing of coupons to count the number of coupons dispensed, as will be described below. An advance switch 142 (FIG. 6), which may be positioned on the rear portion of the apparatus as illustrated, serves to initiate operation of the dispensing apparatus upon filling of magazine 52 with coupons, as will also be described hereinafter.

Figure 9:
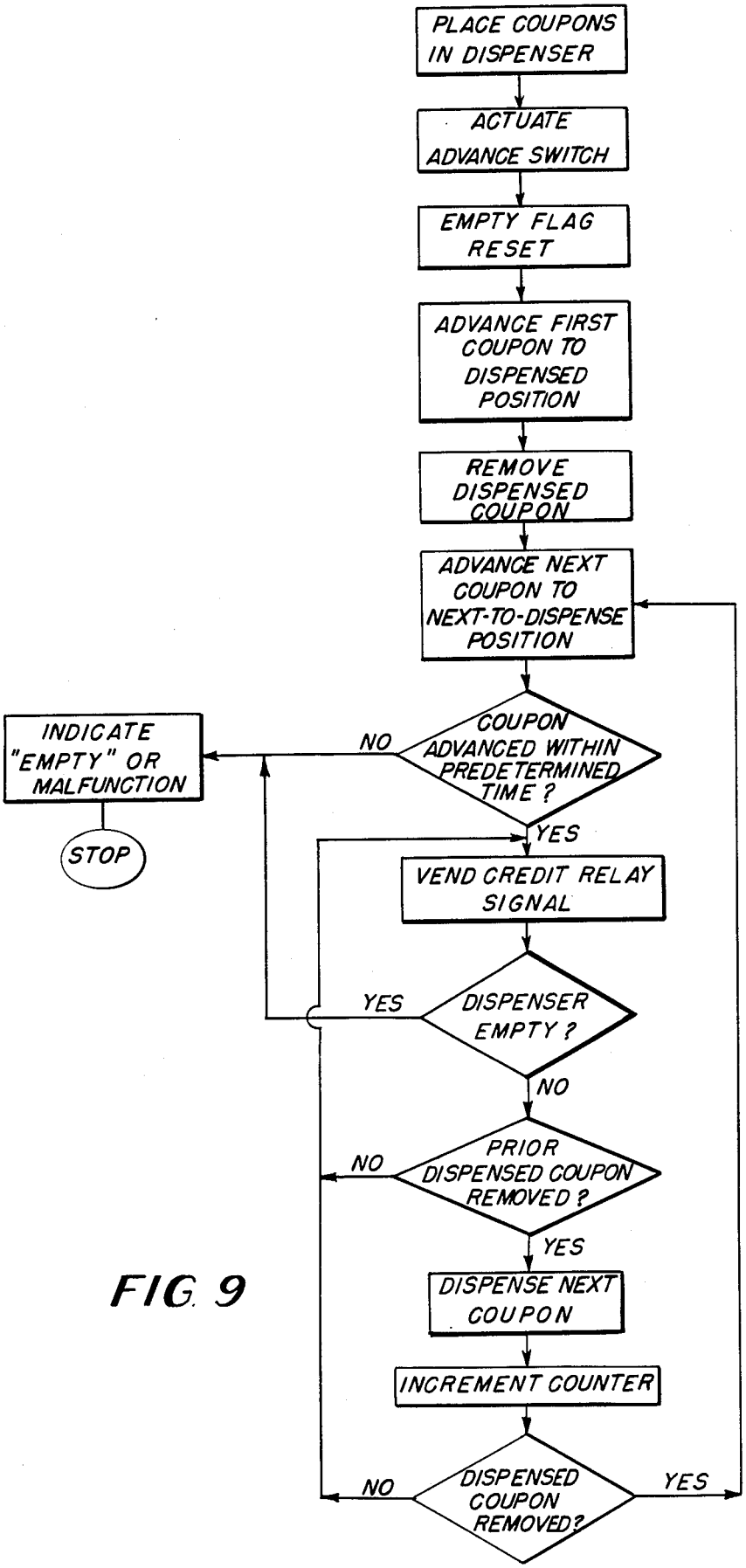
FIG. 9 is a flow chart describing a procedure performed by an automatic sheet dispensing apparatus in accordance with the present invention.

Operation of a coupon dispensing apparatus in accordance with the present invention will be described with reference to FIGS. 9–13 of the drawings. FIG. 9 is a flow chart describing the operational logic of an apparatus in accordance with the invention. FIG. 10 is a side sectional view of an apparatus as described with reference to FIGS. 2–8 during a dispensing operation, certain elements being omitted for clarity. FIGS. 11–13 schematically represent various signals which control operation of dispensing means in accordance with the invention.

In use, it is of course first necessary to provide coupons to the dispensing apparatus in accordance with the invention. This is done by an operator who places a stack of coupons in magazine 52, as indicated in the first portion of the flow chart in FIG. 9. The operator then actuates advance switch 142 which provides a signal, as indicated schematically in FIG. 11. In response to the advance switch signal, an empty "flag" is reset. The empty flag is a code or signal which comprises part of the control logic for the apparatus. It is initially in a state which indicates that the dispenser is empty. Upon provision of coupons and actuation of the advance switch, the flag is reset into a different state for indicating that the apparatus may now dispense coupons.

Advance switch 142 also actuates motor 104 which causes rotation of rolls 62, 72, 82 and 90, as discussed above. As eccentric roll 62 rotates, protrusions 64 will rotate into an upper position whereat they extend through openings 56 in bottom plate 54. The protrusions 64 thus engage bottom-most coupon 136 of a stack of coupons 136' in magazine 52, as illustrated in FIG. 10. Further rotation of roll 62 causes coupon 136 to be advanced in a dispensing direction toward take-out rolls 82 and 90. As shown in FIG. 10, a weight 144 may be provided on top of stack 136' to keep the stack orderly within magazine 52 and to assure that the coupons feed downwardly. Absorber 60 supports the mass of weight 144, as well as the coupons in the stack above the absorber. This reduces the pressure on the lower-most coupons and the dispensing elements of the apparatus, thereby minimizing the risk of jamming or the like.

As coupon 136 is advanced by eccentric roll 62, it also engages and is advanced by rotation of feed roll 72. It is quite common that the bottom-most coupon in the stack will frictionally or otherwise adhere to the next coupon in the stack, causing the next coupon to be likewise advanced in the dispensing direction. However, in accordance with the present invention, separating member 78 cooperates with feed roll 72 to separate bottom-most coupon 136 from adjacent coupons. As coupon 136 is advanced along with any adjacent coupons adhering thereto, each of the advancing coupons encounters separating member 78. However, only bottom-most coupon 136 is urged in the dispensing direction by direct contact with rotating feed roll 72. The remaining coupons encountering separating member 78 are therefor restrained and prevented from proceeding further in the dispensing direction.

As coupon 136 continues to advance, the leading edge thereof will reach a position designated by reference numeral 146 in FIG. 10. At this time, designated $t_0$ in FIG. 11, coupon 136 will interfere with the optical beam between parts 120A and 120B of limit switch 120, causing limit switch 120 to emit a signal as shown in FIG. 11. However, when the apparatus is operating in response to actuation of advance switch 142, the signal from limit switch 120 does not affect operation of the apparatus. The purpose of limit switch 120 will become apparent from the description below. Also substantially at time $t_0$ the leading edge of coupon 136 encounters the periphery of wheel 122, causing the wheel to rotate. As the wheel rotates, sensor 130 produces pulsed signals as light is permitted to pass through slots 132 intermittently brought between parts 130A and 130B.

Responsive to production of a predetermined number of pulses by sensor 130 operation of motor 104 is terminated. This occurs at time $t_1$ as shown in FIG. 11. In the exemplary embodiment discussed herein, operation of motor 104 ceases after sensor 130 produces five pulses. When coupon 136 has advanced beyond position 146 a sufficient distance so as to rotate wheel 122 sufficiently to produce five pulses, coupon 136 will extend beyond take-out rolls 82, 90, past flap 114, extending outwardly of outlet or slot 118. In this position the coupon is considered to be dispensed by the apparatus.

To complete the initial setting operation for the apparatus, the operator then pulls out or removes the coupon which has been advanced to the dispensed position extending outwardly of slot 118. Upon pulling the coupon out in this manner, the coupon further rotates wheel 122 resulting in generation of additional pulses by sensor 130. In the exemplary embodiment, it is presumed that at least two additional pulses are produced upon pulling out of the coupon. When these two pulses are produced, at time $t_2$ as shown in FIG. 11, limit switch 120 becomes deactivated since coupon 136 no longer is positioned between parts 120A and 120B. As a result, motor 104 again begins to operate. Motor 104 will operate until another coupon is advanced in the manner described above to position 146, again causing limit switch 120 to produce a signal at time $t_3$ (FIG. 11). In response to the limit switch signal, motor 104 ceases to operate. The next coupon to be dispensed in thus situated in an intermediate or "next-to-dispense" position with its leading edge situated at approximately position 146, as shown in FIG. 10.

As a result of the operation described above, the apparatus is in a "ready" condition until such time as a coupon is to be dispensed. When a purchaser deposits an appropriate sum of money into vendor 10 and actuates a selector button 24, vendor 10 generates a vend credit relay (VCR) signal which is provided to dispenser 40 in accordance with the invention. Upon termination of the VCR signal, at time $t_4$ as shown in FIG. 12, motor 104 again runs until time $t_5$ when sensor 130 has again produced an appropriate number of pulses upon rotation of wheel 122 as the coupon is advanced to the dispensed position. In response to a predetermined (i.e. 5th) pulse of the sensor, counter 140 of the invention is incremented to accumulate a count of the coupons dispensed. Operation of motor 104 also ceases at time $t_5$ in response to the signal pulse. If the purchaser removes the coupon thus dispensed, two additional pulses will be produced at time $t_6$ and the limit switch 120 will be deactivated as a result of removal of the coupon. Consequently, as described above, motor 104 will again operate until time $t_7$ when yet another coupon is brought to position 146 between parts 120A and 120B of optical limit switch 120.

In the event that a purchaser fails for some reason to remove a coupon which has been dispensed, the apparatus in accordance with the invention will be suspended in an operating condition as represented at time C in FIG. 12. In such condition, motor 104 is deactivated, limit switch 120 emits a signal, and counter 140 has counted the coupon which has been dispensed but not removed from the apparatus. In this condition, the dispensing apparatus will not be responsive to further VCR signals and will therefore not dispense additional coupons. As a result, additional coupons are not dispensed in a wasteful manner until the prior coupon has been taken by a purchaser. The stock of coupons provided to dispenser 40 is therefore utilized in the most efficient manner possible, thereby extending the interval at which the dispenser must be refilled. Additionally, counter 140 accumulates an accurate count of only those coupons which have actually been taken from the apparatus by an individual. This is a distinct improvement over previously known devices which simply spewed forth coupons upon each actuation of the dispenser without regard to whether the coupons were being taken up by purchasers or simply accumulated wastefully in an outlet slot of the dispensing apparatus.

The above-described operation of the apparatus presumes that, upon the removal of a dispensed coupon from slot 118, at least one additional coupon was available in magazine 52 to be subsequently dispensed. However, at some point in time, stack 136' will be exhausted and further dispensing of coupons will not be possible. Operation of the apparatus in this circumstance will be described with reference to FIG. 13 of the drawings.

As shown in FIG. 13, the last coupon in magazine 52 will be dispensed, resulting in a sequence of signals and operations as represented at times $t_4$–$t_6$, corresponding to the description of such operation at corresponding times as shown in FIG. 12. As shown in FIG. 13, at time $t_6$, when the last coupon is removed from the apparatus by a purchaser, the signal from limit switch 120 ceases and motor 104 begins to run. However, since no coupons remain in magazine 52, no coupon is advanced to intermediate position 146. Thus, limit switch 120 is not activated. A timer (not shown) associated with the control circuitry of the apparatus determines when motor 104 has run for a predetermined time T without a signal from limit switch 120. Upon expiration of period T with no signal from limit switch 120, at time $t_8$ as shown in FIG. 13, operation of motor 104 is terminated and an appropriate signal is provided to indicate that the magazine 52 is empty. The above-noted empty flag may thus be set into a condition indicating that the apparatus is empty, and an appropriate visual indication or the like may be provided, if desired, as suggested by the flow chart of FIG. 9. Further operation of dispenser 40 is no longer possible. Upon receipt of a subsequent VCR signal, at time $t_9$ as shown in FIG. 13, dispenser 40 does not respond.

Of course, it is possible that a damaged coupon or the like may cause jamming within magazine 52 when dispensing of such coupon is attempted. As a result of such jamming, a coupon will be advanced to position 146, much in the manner as would occur if no coupon were present in the magazine. In response to the absence of an advancing coupon within period T as a result of jamming, an "empty" signal would likewise be provided in the manner described above.

The present invention thus provides an improved sheet or coupon dispensing apparatus. Particularly, features of the dispensing apparatus render it especially suitable for use in conjunction with automatic vending equipment and other automatic machinery or devices. While the invention has been described with reference to the accompanying drawings, it is not limited to the details shown therein as obvious modifications may be made by those of ordinary skill in the art, the invention being limited only by the claims appended hereto.

We claim:

1. Sheet dispensing apparatus comprising:

storage means for storing a plurality of sheets;

outlet means for passing dispensed sheets out of said apparatus;

means for detaining said sheet in a ready position intermediate that of said storage means and said outlet means;

dispensing means including a first roller adjacent said storage means for advancing a sheet therefrom toward said outlet means;

a second single roller intermediate to said first roller and said outlet means for advancing said sheet from said first roller toward said outlet means;

holding means for holding a dispensed sheet in a dispensed position at said outlet means whereat such sheet is at least partially exposed outwardly of said outlet means;

said holding means including a pair of opposed rollers positioned in proximity to said outlet means;

said dispensing means further including a separating member adjacent said second single roller for separating a sheet to be dispensed from adjacent sheets;

said dispensing means advancing a sheet from said storage means to said intermediate ready position prior to dispensing said sheet to said outlet means;

sensor means for determining the presence of a sheet at said intermediate ready position;

means for determining when a sheet in said dispensed position has been totally removed from said apparatus, said means for determining being a sensor in proximity to said holding means wherein said sensor includes a movable element in contact with a sheet in the dispensed position and means for determining movement of said movable element upon removal of such sheet from the apparatus; and means for enabling said dispensing means, in response to said means for determining, upon input of a signal to said dispensing apparatus.

2. The apparatus according to claim 1, wherein said movable element is a wheel having a plurality of radial slots at the inner periphery thereof, the circumference of said wheel being in contact with a sheet in the dispensed position.

3. The apparatus according to claim 1, wherein said sensor includes optical means aligned with said radial slots for sensing movement of said movable element.

4. The apparatus according to claim 1, wherein said sensor means comprises an optical sensor adjacent the intermediate position.

5. The apparatus according to claim 1, wherein said sensor means further determines when a sheet has been advanced from the intermediate position to said dispensed position.

6. The device according to claim 1, further comprising means for counting the number of sheets dispensed by said apparatus.

7. The device according to claim 1, wherein said means for enabling comprises a sensor in proximity to an outlet portion of said dispensing means for sensing a sheet in a dispensed position, said sensor providing a signal for enabling dispensing of a subsequent sheet upon removal of said sheet from said dispensed position.

8. Sheet dispensing apparatus comprising:

storage means for storing a plurality of sheets;

advancing means for propelling one of said plurality of sheets from said storage means to a ready position;

dispensing means for propelling said sheet from said ready position to a dispense position whereat said sheet partially extends from said apparatus;

means for detaining said sheet in said ready position intermediate that of said storage means and said dispense position;

first sensor means for generating a first signal indicating that said sheet is at said ready position;

second sensor means for generating a second signal indicating that said sheet is at said dispense position;

third sensor means for generating a third signal indicating that said sheet has been totally removed from said apparatus; and means for enabling said advancing means in response to said third signal.

9. Sheet dispensing apparatus according to claim 8, wherein said apparatus is associated with a vending machine, said vending machine comprising means for enabling said advancing means upon each purchase from said vending machine.

10. Sheet dispensing apparatus according to claim 8 wherein said dispenser means includes a wheel having a plurality of radial slots around its inner periphery and wherein said second sensor means includes a photocell and associated light source optically aligned with said radial slots of said wheel such that a first predetermined number of pulses are generated by rotation of said wheel as said radial slots permit light to be emitted therethrough to the photocell, said predetermined number of pulses being generated when said sheet has passed from said ready position to said dispense position.

11. Sheet dispensing apparatus according to claim 8 wherein said third sensor means determines when a second predetermined number of pulses is generated by rotation of said wheel, said predetermined number of pulses being generated when said sheet has been totally removed from said dispense position.

12. Sheet dispensing apparatus according to claim 8 wherein said advancing means is an electric motor which propels a first roller adjacent said storage means.

13. Sheet dispensing apparatus for dispensing a sheet in response to an externally generated stimulus comprising:

storage means for storing a plurality of sheets;

a first roller adjacent said storage means for advancing a sheet therefrom along a dispensing path in an advancing direction;

a second roller downstream of said first roller in said advancing direction for further advancing a sheet;

a separating member cooperable with said second roller for separating a sheet to be dispensed from adjacent sheets;

first sensor means for generating a first signal when a sheet to be dispensed reaches a ready position along said dispensing path;

opposed holding rollers downstream of said ready position for holding a sheet in a dispense position whereat such sheet is at least partially exposed outwardly of said apparatus;

means for detaining said sheet in said ready position intermediate that of said storage means and said dispense position;

second sensor means adjacent said dispensing path for generating a second signal when a sheet reaches said dispense position;

third sensor means for generating a third signal indicating that a sheet has been totally removed from said dispense position; and means for enabling said first roller in response to said third signal.

* * * * *